United States Patent [19]

Darovec

[11] Patent Number: 4,900,637

[45] Date of Patent: Feb. 13, 1990

[54] TAG FOR LABELING AN ARTICLE CAST FROM MOLTEN MATERIAL, METHOD THEREFORE AND ARTICLE

[75] Inventor: James L. Darovec, Bettendorf, Iowa

[73] Assignee: Aluminum Company of America, Alcoa Center, Pa.

[21] Appl. No.: 254,702

[22] Filed: Oct. 7, 1988

[51] Int. Cl.[4] ..... B22D 19/00; G09F 3/04

[52] U.S. Cl. ..... 428/577; 428/601; 428/609; 164/111; 164/DIG. 6; 40/299

[58] Field of Search ..... 164/111, DIG. 6; 40/299, 625, 628, 629, 909, 911, 912, 913; 249/103, 104; 428/609, 601, 544, 576, 577-585

[56] References Cited

U.S. PATENT DOCUMENTS

| | | | |
|---|---|---|---|
| Re. 11,704 | 11/1988 | Haugh et al. | 164/111 |
| 27,111 | 2/1860 | McCammon | 164/111 |
| 121,036 | 11/1871 | Aiken | 164/111 |
| 251,745 | 1/1882 | Thomas | 40/629 |
| 678,997 | 7/1901 | Gorton | 164/111 |
| 1,186,693 | 6/1916 | Siggins | 164/111 |
| 1,251,491 | 1/1918 | Ferriss | 40/912 |
| 1,401,283 | 12/1921 | Schumacher | 164/111 |
| 1,477,466 | 12/1923 | Terhaar | 40/629 |
| 1,492,633 | 5/1924 | Heywood | 40/629 |
| 1,511,144 | 10/1924 | Trueblood | 40/629 |
| 1,561,427 | 11/1925 | Forsberg | 164/111 |
| 1,789,431 | 1/1931 | Epstein | 40/629 |
| 1,887,324 | 11/1932 | Pocokoba | 40/629 |
| 2,127,043 | 8/1938 | Most | 164/111 |
| 2,761,229 | 9/1956 | Friedly et al. | 40/629 |
| 3,216,105 | 11/1965 | Gollwitzer | 164/111 |
| 3,621,809 | 11/1971 | Paxton | 164/111 |
| 3,673,717 | 7/1972 | Latschbacher | 40/2 |
| 3,712,079 | 1/1973 | Eberle | 63/15 |
| 4,061,174 | 12/1977 | Edwards | 249/103 |
| 4,097,019 | 6/1978 | Connors | 249/204 |
| 4,139,590 | 2/1979 | Rubright | 264/255 |
| 4,161,830 | 7/1979 | Gentil | 40/629 |
| 4,599,772 | 7/1986 | Graham | 29/156.5 R |
| 4,694,596 | 9/1987 | East | 40/628 |
| 4,715,799 | 12/1987 | Eiermann | 418/61 A |
| 4,720,625 | 1/1988 | Arney et al. | 235/145 R |

FOREIGN PATENT DOCUMENTS

| | | | |
|---|---|---|---|
| 510538 | 4/1952 | Belgium | 164/111 |
| 2629627 | 1/1977 | Fed. Rep. of Germany | 249/103 |
| 598216 | 12/1925 | France | 40/628 |

OTHER PUBLICATIONS

ID Systems, Jun. 1988, pp. 11-14, 16, 17, 20 and 21, Article Entitled: Rough and Ready by Dennis Bathory Kitsg and Rip Keller.

*Primary Examiner*—John J. Zimmerman
*Attorney, Agent, or Firm*—Jones, Tullar & Cooper

[57] ABSTRACT

A tag structure for labeling an article cast from molten material including a portion which submerges in the molten material and a portion which contacts the surface of the molten material, and preferably floats on the surface of the molten material. The submerged portion forms a bond with the material forming the article as the material solidifies. A bath of the molten material is provided and the tag is brought into contact with surface of the molten material in the bath, for example, it is dropped onto the surface of the molten material in the bath. The tag if dropped sinks under its own weight into the molten material forming the bond noted above. The portion of the tag which is not submerged bears information relative to the article to be formed. The completed article has, therefore, a tag firmly attached thereto which is placed on the article during formation of the article and not thereafter.

24 Claims, 4 Drawing Sheets

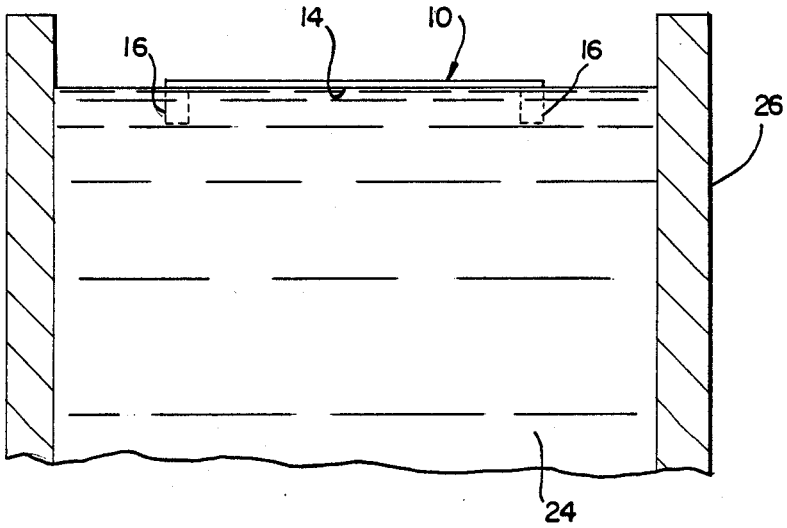
FIG 10
FIG 11
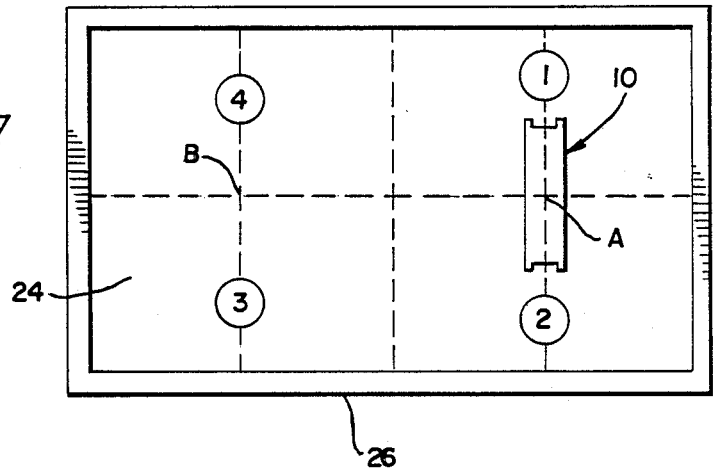
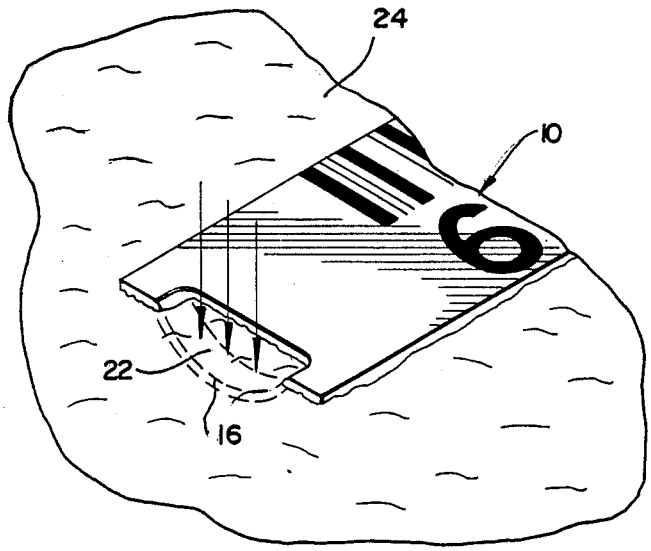
FIG 12

TAG FOR LABELING AN ARTICLE CAST FROM MOLTEN MATERIAL, METHOD THEREFORE AND ARTICLE

BACKGROUND OF THE INVENTION

1. Field of the Invention

The present invention relates to a tag structure for attachment to an article cast from molten material, to a method for labeling an article cast from a molten material and to an article cast from molten material including a tag having human or machine readable markings relative to the article, such as article identification.

Upon completing the manufacture of an article cast from a molten material, there is a need to provide the subsequent user with a clear identification and other information relating to the article. For example, if the article is in its usable final form, product information such as price and weight may be useful. If the article is utilized in combination with various other items, a clear description of its individual function may be required. Further, production schedules may require inventory information to be displayed on the article. If the article is simply in an intermediate form to be subjected to further processing, information regarding the individual article's composition may be required for the final processing steps.

2. Description of The Prior Art

Certain methods are known for providing a display of information on articles in general. One method, perhaps the most common method, includes the application of a label coated with an adhesive backing which is adhered to the article. Unfortunately, many of these labels lack sufficient adherence to provide a reliable bond between the label and the article for extended periods of time.

Another method includes the attachment of a label in the form of a structural tag to the article by physically driving retaining projections which are integral with the tag into the article. An example of such a tag and process is disclosed in U.S. Pat. No. 3,673,717. Use of tags with these projections in such a process may subject the article to unwanted damage or at least create stresses within the article. Further, the hardness of the article to be labeled may preclude use of this method. This is especially likely in articles which are cast from molten material, such as aluminum, for example.

Another method, specific to cast molten material articles, includes the attachment of a label or tag before solidification of the molten material. An example of such a process is disclosed in U.S. Pat. No. 1,561,427. The process disclosed in this patent includes assembling individual characters on a strip to form a number or word, embedding the entire strip into a mold and casting the metal in the mold.

Regarding this process, it should be noted that a number of individual characters must be arranged to create the marking. This may be time consuming and laborious, especially if much information is to be conveyed. Further, computer bar codes which are often used in many of today's products cannot be embedded in this manner. Also, repeated impression of the markings into the mold may eventually cause damage to the mold surface.

Stenciling and riveting are also known methods used with cast articles after the articles are made.

It can be seen that labeling an article can proceed during the making of the article or after the article is made, with the latter being the predominate mode.

SUMMARY OF THE INVENTION

According to the present invention the former mode is preferred. The present invention has proven to be advantageous as it does not interfere with production of the article, is made separate from the article, but made such that it can adhere effectively to the article, and retain its adherence for an indefinite period of time.

The label according to the present invention has the form of a structural member and will accordingly be referred to as a tag. The tag has structural integrity and is arranged so that it will not be damaged when it is joined to the molten material from which the cast article is being made during the production of the cast article. It possesses the capability of being joined to the molten material during the production of the cast article so that a bond or attachment arises between the tag and the article as the article is made.

According to the present invention, the tag is not attached to a mold. Instead it is floated on the surface of the molten material from which the cast article is formed prior to solidification of the material, i.e., while the material of the article is in a molten state. A portion of the tag is submerged in the molten material and another portion engages the surface of the molten material. In this condition, the tag floats on the molten material and the submerged portion is essentially surrounded by molten material for better adherence. A portion of the tag bears identification information and this portion does not submerge and is clearly visible when the tag is floating. In the process of solidification, the submerged portion of the tag forms a bond with the material of the article and is consequently adhered thereto.

The finally formed article is unique because it bears a tag which has been uniquely joined thereto and is nonremovable therefrom.

A number of advantages result from the present invention. Among these are: the avoidance of any mold preparation prior to article formation; the elimination of any post article formation working; minimal effort in achieving adherence of the tag and cast article; and an effective bond resulting in a permanent attachment without damage to the article.

BRIEF DESCRIPTION OF THE DRAWINGS

Twelve figures have been selected to illustrate a preferred embodiment of the present invention. These figures are schematic in nature. Nevertheless, they are sufficiently detailed so that those skilled in the art will be able to practice the invention and fully comprehend the scope of the invention. Included are:

FIG. 6, which is a side elevation view of the tag of FIG. 4;

FIG. 10, which illustrates a bath of cast material with the tag according to the present invention floating in the bath;

FIG. 11, which is a top view of the bath of cast material illustrating a preferred location of the tag; and FIG. 12, which is a partial perspective view which focuses on one end of the floating tag and its submerged attachment projection.

DESCRIPTION OF THE PREFERRED EMBODIMENT

According to a preferred form of the present invention, the tag is made from anodized aluminum sheet having strips each preferably drawn into a smooth loop from the edges of the tag. The article comprises cast aluminum metal units, such as ingots formed in a conventional manner. The tag is dropped onto the molten aluminum and the strips sink into the molten aluminum where they become embedded during the final stages of the casting process, i.e., the tag when dropped onto the surface of the molten aluminum, floats on the surface while the strips are submerged in the molten aluminum. As the molten aluminum solidifies (freezes) into an ingot, the strips are bonded or adhered to the ingot.

Preferably, the tag structure of the present invention includes a planar rectangular sheet 10, with a top surface 12 and a bottom surface 14. The sheet may be constructed of any material suitable to display human or machine readable markings (FIGS. 1, 4 and 7) that will also withstand the heat of the molten material from which the labeled article will be formed. The anodization serves as one means of insulating the tag so that the tag withstands the heat of the molten material.

At least one, but preferably two strips serving as attachment projections 16 are formed, preferably by drawing in a known manner, from the sheet 10 and project outwardly from the bottom surface 14 of the sheet. The attachment projections 16 are preferably smooth, and according to one variant, are formed as semicircular loops along the periphery of the sheet 10.

Figure 3:
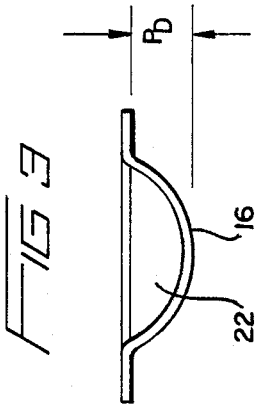
FIG. 3, which is a side elevation view of the tag of FIG. 1.
Figure 2:
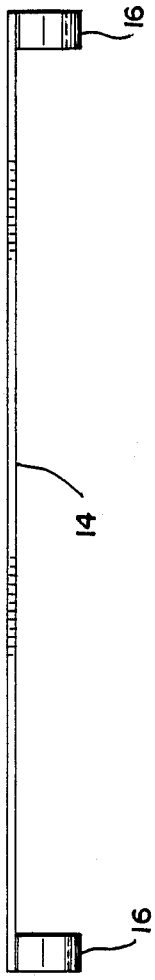
FIG. 2, which is a front elevation view of the tag of FIG. 1.
Figure 1:
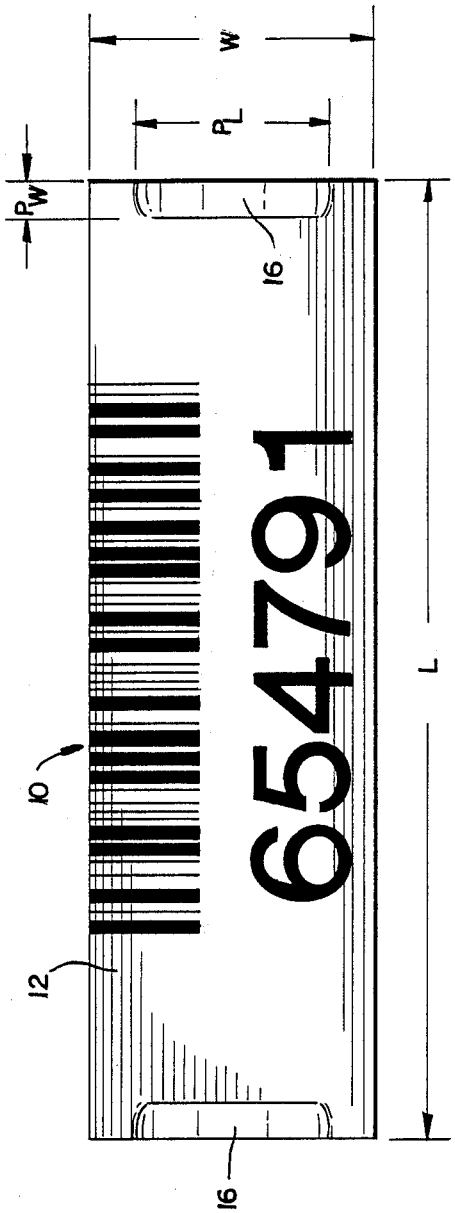
FIG. 1, which is a top plan view of a tag in accordance with one variant of the present invention.

As shown in the variant embodiment of FIGS. 1–3, the article attachment projections 16 are formed along the width edge of the rectangular sheet 10 but do not extend the entire width of the rectangular sheet. In another variant embodiment shown in FIGS. 4–6, the attachment projections 16 are formed inboard of the outer edge of the sheet 10 toward the sheet center but remain parallel to that edge. In both variants shown in FIGS. 1–6, the attachment projections 16 are, as noted, formed as semicircular, continuous loops, whereas in the variant shown in FIGS. 7–9, the attachment projections 16 are formed as discontinuous loops having a somewhat flattened surface 18 with a passage 20. According to all the variants, the attachment projections 16 define an opening 22.

Figure 8:
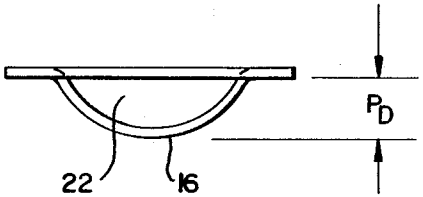
FIG. 8, which is a front elevation view of the tag of FIG. 7.
Figure 9:
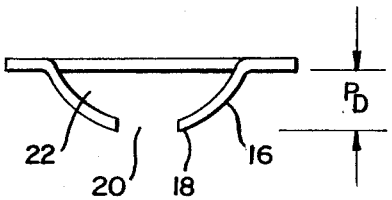
FIG. 9, which is a side elevation view of the tag of FIG. 7.
Figure 8:
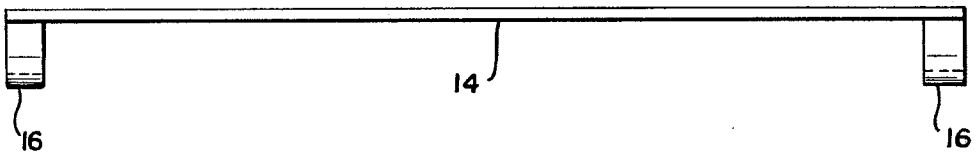
Figure 7:
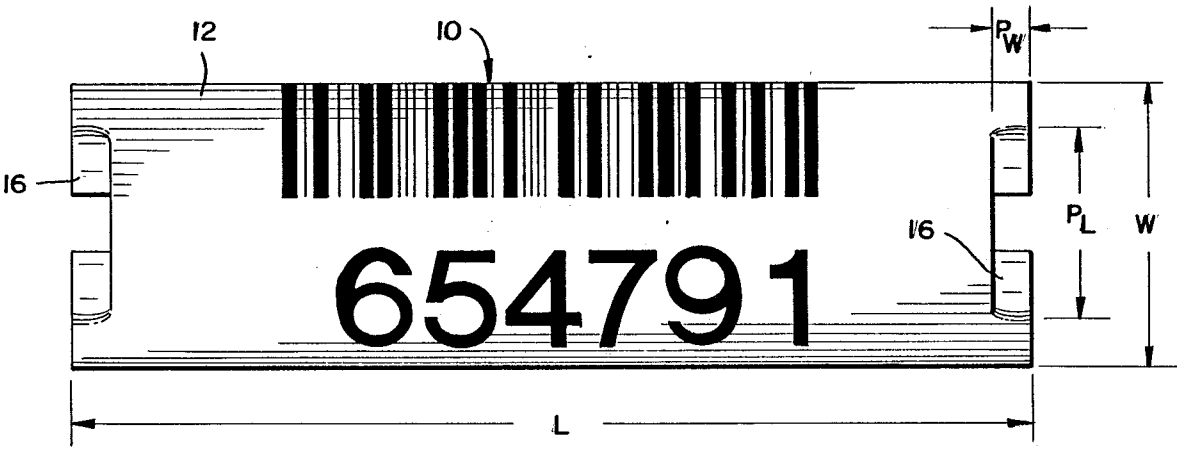
FIG. 7, which is a top plan view of a tag in accordance with another variant of the present invention.

When attaching the tag to an article cast from molten material, such as molten aluminum, the tag is dropped onto the surface of a molten material bath 24 to be solidified in a mold 26, as shown in FIG. 10. Preferably the tag is dropped at the imaginary intersection A or B, between the 1st and 2nd or 3rd and 4th sectors, respectively, of the top surface of the molten material bath, as illustrated in FIG. 11, because of the inherent depression formed in the center region of solidifying aluminum material (aluminum ingot). The weight of the tag under gravity causes the attachment projections 16 to locally break the surface tension at the top surface of the molten material bath and sink into the molten material until the bottom surface 14 of the tag engages the top surface of the molten material bath 24. When the bottom surface 14 engages the top surface of the molten material bath 24 the surface tension at the top surface allows the tag to float on the top surface. The result is that the tag floats while the attachment projections 16 are submerged. By dropping the tag from an appropriate height splashing of the molten material onto the top surface 12 of the tag, which might damage or at least conceal the markings thereon, is avoided as is sinking of the tag itself. As the attachment projections 16 sink, the molten material flows through the openings 22 (FIGS. 1–9, 8–10, and 12) as well as passage 20 (FIGS. 7–9). The molten material, therefore, surrounds the attachment projections 16 thereby stabilizing, along with the surface tension at the top surface 12, the location of the tag. Upon solidification of the molten material, the attachment projections 16 are adhered to the solidified material.

It will be appreciated by one of ordinary skill in the art that density and other physical properties of the molten material bath 24 will be determinative of the material and physical dimensions of the tag so that the result noted above can be achieved.

For example, three tags were made from 0.062 in. gauge anodized aluminum sheet having the following dimensions: $L=5.0$ in.; $W=1.5$ in; $P_L=1.0$ in; $P_W=0.375$ in.; $P_D=0.375$ in. The top surface of the tags were provided with printed matter as shown in FIG. 1, while the bottom surface of the tags and all surfaces of the attachment projections 16 were given a 0.3 mil thick anodization layer (not shown).

The tags so constructed were dropped onto a bath of molten 2024 alloy aluminum which was subsequently solidified to form an aluminum ingot. The tags were dropped with their top and bottom surfaces situated substantially parallel to the bath surface, from approximately 4 in. above the bath surface and at the center of a quadrant as shown in FIG. 11. From this height, and with this orientation, it was found that the tags caused negligible disturbance to the molten material bath surface. So that, as noted above, splashing was effectively prevented. The attachment projections 16 sank quickly followed by contact and wetting of the bottom surface 14. A stable floating condition ensued with almost no noticeable movement of the tags in the bath, do perhaps in part, as noted above, to the holding forces exerted by the molten material on the attachment projections 16, as schematically illustrated by the arrows in FIG. 12. Adherence of the attachment projections 16, with casting material surrounding the loop surfaces, was complete. Minimal, if any, fading of the printed matter occurred on the tags tested, ingot cracking at the tag ingot interface was not found, and removal of the tags was impossible without physically chiseling the tags from their ingots.

In other tests conducted, it was observed that some tags experienced a thermal shock on their anodized layer causing "crazing", i.e., break down of the anodozied layer, which adversely affects the bar code on the surface 12 as well as the tag itself because the heat of the molten material bath will as a result have access to the tag material causing melting of the tag. One solution to this problem would be to spray a lacquer on the top surface of the tag after it is dropped. Another solution was found to be the timing related to the solidification cycle of the molten material. A time period of 4 to 5 min. prior to solidification was found acceptable for dropping the tags to avoid break down of the anodized layer.

Figure 5:
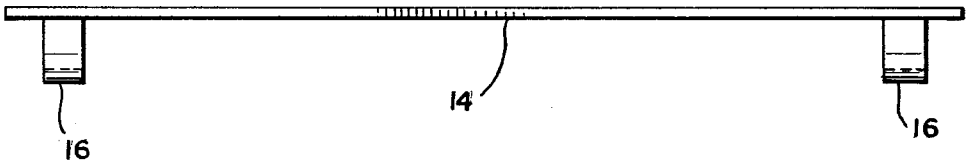
FIG. 5, which is a front elevation view of the tag of FIG. 4.
Figure 4:
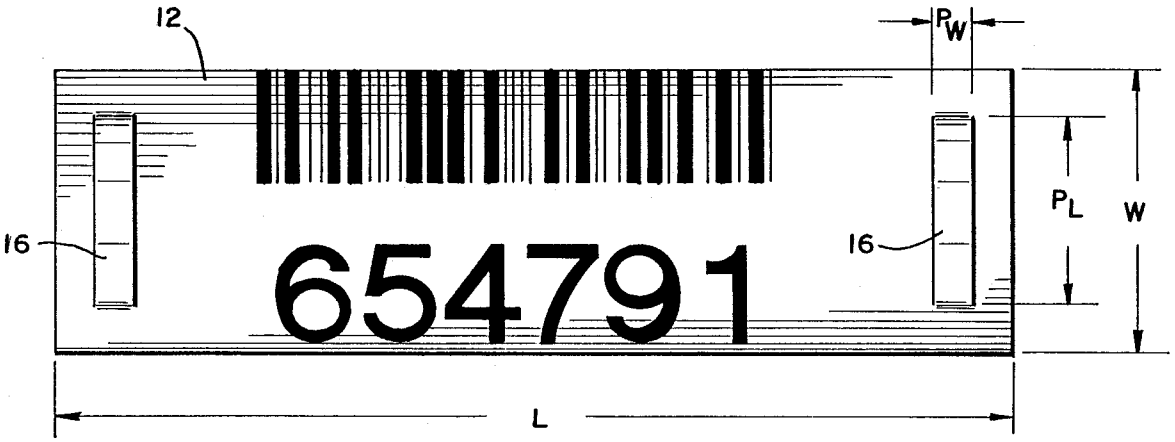
FIG. 4, which is a top plan view of a tag in accordance with another variant of the present invention.

The number and exact location of the projections 16 is arbitrary. Two attachment projections 16 are shown in the variants of FIGS. 1–3, 4–6 and 7–9. In FIGS. 4–6, the location of the attachment projections 16 are spaced inboard of the outer width edges of the sheet 10, whereas as shown in FIGS. 1–3, and FIGS. 7–9, the outer width edges of the sheet 10 form part of the projections 16.

While the preferred embodiment in its variants has been described in conjunction with the labeling of an aluminum ingot, it should be understood that the invention is not so limited. For example, if the article is steel the tag could be made of, for example, ceramic material having similar dimensional characteristics to that of the preferred embodiment.

The important consideration is that the attachment projections 16 must allow the sheet 10 to reach a floating condition without submerging the information on the surface 12, and must be capable of adequately adhering the tag to the solidified article.

What is claimed is:

1. A tag for labeling an article formed by solidification of a molten material in a molten material bath, comprising:

a structural sheet having a portion including a surface with machine or human readable markings thereon, and at least one article attachment projection extending outwardly from said portion and defining with said portion a passage for flow therethrough of molten material, whereby upon contact of each attachment projection with the molten material bath each attachment projection sinks into the molten material bath exposing its passage to the molten material for flow therethrough and bringing said portion into contact with the surface of the molten material, which contact is maintained while the molten material solidifies, thereby adhering each attachment projection to the solidified material.

2. The tag as defined in claim 1, wherein each attachment projection comprises a loop.

3. The tag as defined in claim 2, wherein each loop is formed from said structural sheet.

4. The tag as defined in claim 1, wherein said portion includes substantially parallel top and bottom surfaces, with the machine or human readable markings on the top surface and said attachment projections extending outwardly from the bottom surface.

5. The tag as defined in claim 1, wherein the structural sheet comprises an anodized sheet of aluminum alloy.

6. The tag as defined in claim 1, wherein each attachment projection has a length, width and depth relative to said portion, and wherein said depth is less than 1.0 in.

7. An article formed by solidification of a molten material bath comprising: a solidified mass of previously molten material; and a tag adhered thereto, said tag comprising: a structural sheet having a portion including a surface on which information relative to the article is displayed; and at least one article attachment projection extending outwardly from said portion and defining with said portion a passage for flow therethrough of molten material, each attachment projection being embedded in said article during solidification of the molten material to effect said adherence.

8. The article and tag as defined in claim 7, wherein said article comprises an aluminum ingot.

9. The article and tag as defined in claim 8, wherein said tag is formed of an anodized sheet of aluminum alloy.

10. The article as defined in claim 8, wherein each attachment projection has a length, width and depth relative to said portion, and wherein said depth is less than 1.0 in.

11. A method of labeling an article cast from molten material, comprising the steps of providing a bath of molten material to be solidified;

floating a tag, bearing information relative to the article to be formed, on the surface of said bath, the tag while floating being partially submerged in the bath; and solidifying the material in said bath to form the article while the tag is partially submerged, producing an adherence of the tag to the article.

12. The method as defined in claim 11, wherein the molten material is aluminum.

13. The method as defined in claim 12, wherein the tag is an anodized aluminum alloy sheet material.

14. A method of labeling an article cast from molten material, comprising the steps of providing a bath of molten material to be solidified; and bringing a tag, bearing information relative to the article to be formed, into contact with the surface of said bath, and solidifying the material in said bath to form the article while the tag is in contact therewith, producing an adherence of the tag to the article.

15. The method as defined in claim 14, wherein the molten material is aluminum.

16. The method as defined in claim 15, wherein the tag is an anodized aluminum alloy sheet material.

17. A tag for labeling an article formed by solidification of a molten aluminum alloy in a molten aluminum alloy bath, comprising:

a structural sheet having a portion including a surface with machine or human readable markings thereon, and at least one article attachment projection extending outwardly from said portion and defining with said portion a passage for flow therethrough of molten aluminum alloy, each attachment projection having spaced apart ends each integrally formed with said portion, and upon contact of each attachment projection with the molten aluminum alloy bath each attachment projection sinks into the molten aluminum alloy bath exposing its passage to the molten aluminum alloy for flow therethrough and bringing said portion into contact with the surface of the molten aluminum alloy, which contact is maintained while the molten aluminum alloy solidifies, thereby adhering each attachment projection to the solidified aluminum alloy.

18. The tag as defined in claim 17, wherein each attachment projection comprises a loop.

19. The tag as defined in claim 18, wherein each loop is formed from said structural sheet.

20. The tag as defined in claim 17, wherein said portion includes substantially parallel top and bottom surfaces, with the machine or human readable markings on the top surface and said attachment projections extending outwardly from the bottom surface.

21. The tag as defined in claim 17, wherein the structural sheet comprises an anodized sheet of aluminum alloy.

22. The tag as defined in claim 17, wherein each attachment projection further has a length, width and depth relative to said portion, and wherein said depth is less than 1.0 in.

23. A tag for labeling an article formed by solidification of a molten material in a molten material bath, comprising:

a structural sheet having a portion including a top surface with machine or human readable markings thereon, a bottom surface, and at least one article attachment projection extending outwardly from said bottom surface away from the machine or human readable markings, each attachment projection having a length, width and depth relative to said portion such that, upon contact of each attachment projection with the molten material bath, each attachment projection sinks into the molten material bath bringing said bottom surface into contact with the surface of the molten material, said contact creating a floating condition of the tag which is maintained while the molten material solidifies, thereby adhering at least each attachment projection to the solidified material.

24. The article as defined in claim 22, wherein depth of each attachment projection is less than 1.0 in.

* * * * *